US007461753B1

(12) United States Patent
Gatta et al.

(10) Patent No.: US 7,461,753 B1
(45) Date of Patent: Dec. 9, 2008

(54) PRACTICAL INTELLIGENT ASSIST DEVICE

(76) Inventors: Raymond P. Gatta, 435 Gentry Dr., Aurora, OH (US) 44202; Matthew L. Myers, 4466 Maplepark Rd., Stow, OH (US) 44224; Marc W. Yanko, 12053 Woodin Rd., Chardon, OH (US) 44024

( * ) Notice: Subject to any disclaimer, the term of this patent is extended or adjusted under 35 U.S.C. 154(b) by 252 days.

(21) Appl. No.: 11/004,509

(22) Filed: Dec. 6, 2004

(51) Int. Cl.
*B66C 19/00* (2006.01)

(52) U.S. Cl. ..... 212/331; 700/213

(58) Field of Classification Search ..... 212/331; 700/213

See application file for complete search history.

(56) References Cited

U.S. PATENT DOCUMENTS

| | | | | | |
|---|---|---|---|---|---|
| D277,795 | S | * | 2/1985 | Griffiths | D34/35 |
| 4,667,834 | A | * | 5/1987 | Lanigan et al. | 212/288 |
| 5,037,267 | A | | 8/1991 | Warner et al. | |
| 5,181,823 | A | * | 1/1993 | Hussey et al. | 414/730 |
| 5,443,151 | A | | 8/1995 | Taylor | |
| 5,452,981 | A | * | 9/1995 | Crorey et al. | 198/468.6 |
| 5,694,857 | A | | 12/1997 | Taylor | |
| 5,799,581 | A | | 9/1998 | Taylor | |
| 5,865,487 | A | * | 2/1999 | Gore et al. | 294/2 |
| 6,204,620 | B1 | | 3/2001 | McGee et al. | |
| 6,269,944 | B1 | | 8/2001 | Taylor | |
| 6,312,211 | B2 | | 11/2001 | Tranchida | |
| 6,313,595 | B2 | | 11/2001 | Swanson et al. | |
| 6,386,513 | B1 | * | 5/2002 | Kazerooni | 254/270 |
| 6,575,317 | B2 | | 6/2003 | Taylor | |
| D477,901 | S | | 7/2003 | Robinson | |
| 6,612,449 | B1 | | 9/2003 | Otani et al. | |
| 6,668,668 | B1 | | 12/2003 | Peshkin | |
| 6,738,691 | B1 | | 5/2004 | Colgate et al. | |
| 6,974,044 | B1 | * | 12/2005 | Munnekehoff | 212/331 |
| 2002/0111711 | A1 | * | 8/2002 | Peshkin et al. | 700/230 |
| 2002/0111712 | A1 | | 8/2002 | Peshkin et al. | |
| 2002/0112016 | A1 | | 8/2002 | Peshkin et al. | |
| 2004/0026349 | A1 | | 2/2004 | Colgate et al. | |

* cited by examiner

*Primary Examiner*—Thomas J. Brahan
(74) *Attorney, Agent, or Firm*—John D. Gugliotta, PE, Esq.

(57) ABSTRACT

A practical intelligent assist device is provided that eliminates the complex use of force sensing weigh cells and vector interpreting software. By simplifying the input to a series of traditional voltage inputs, i.e. 1-4 volt signals, the use of standard available control componentry becomes available. Utilizing a series of such simplified inputs, including a load angle feedback, the processing of the vector math can be accomplished within a programmable logic controller (PLC). Outputs can then be simply generated to control a series of 0-60 Hz digital signals to drive direct drive motors.

15 Claims, 5 Drawing Sheets

PRACTICAL INTELLIGENT ASSIST DEVICE

RELATED APPLICATIONS

There are no previously filed, nor currently any co-pending applications, anywhere in the world.

BACKGROUND OF THE INVENTION

1. Field of the Invention

The present invention relates to the field of intelligent assist devices (IAD), and in particular, to a practical intelligent assist device (PIAD) that can interact with human operators in a practical, easily maintainable fashion.

2. Description of the Related Art

In an industrial application such as a manufacturing assembly line or general material handling situation, the payload may be too large for a human operator to move without mechanical assistance or risking injury. Even with lighter loads it may be desirable to provide a human operator with mechanical assistance in order to allow more rapid movement and assembly, avoid strain, fatigue or repetitive motion injuries. Thus, a great deal of industrial assembly and material handling work is done with the help of personnel assist devices.

Intelligent Assist Devices ("IADs") are a class of computer-controlled machines that interact with a human operator to assist in moving a payload. IADs may provide a human operator a variety of types of assistance, including supporting payload weight, helping to overcome friction or other resistive forces, helping to guide and direct the payload motion, or moving the payload without human guidance. The Robotics Industries Association T15 Committee on Safety Standards for Intelligent Assist Devices describes IADs as a single or multiple axis device that employs a hybrid programmable computer-human control system to provide human strength amplification, guiding surfaces, or both. These multifunctional assist devices are designed for material handling, process and assembly tasks that in normal operation involve a human presence in its workspace. Typically, Intelligent Assist Devices (IADs) are force-based control devices that range from single axis payload balancing to multiple degree of freedom articulated manipulators.

However, the use of forced-based control in particular, and intuitive directional control in general, can lead to many practical problems on the factory floor. Such systems and devices are complicated, both electronically and control wise. These systems must estimate or predict the control functions of the operator from limited inputs, and these limited inputs are subject to ambiguity, interference, and downright failure. For example, with only one physical input, i.e. force applied to a load cell on the operator control, an IAD will need to gauge and predict the desired direction (in both "x" and "y" planes) and speed, while at the same time taking into account vibration within the facility, structural interferences of the assembly line, safety of the operator (position relative to direction of travel), variations among different individual operators and, possibly, unintentional input by the operator. The typical commercial response to these challenges has been an over technical, over engineered control algorithm that requires complex damping, calibration, and tuning. Further, such solutions require constant re-assessment in a manner that is difficult for the arena in which they are operated. In other words, typical facilities do not have the technical resources or proprietary know-how for maintaining such devices.

A need exists to provide a practical intelligent assist device (PIAD) to merge the best of the powered assistance currently available with current IAD's, but with an easier to program and maintenance characteristics. Consequently, a need has been felt for providing an intelligent assist device that is direct and easy to operate, while at the same time being capable of being programmed, tuned, and maintained without the need of specialty hardware or technical resources that are generally unavailable in most manufacturing settings.

SUMMARY OF THE INVENTION

It is therefore an object of the present invention to provide an improved intelligent assist device.

It is a feature of the present invention to provide an improved intelligent assist device that a man-machine interface that is clearly and ergonomically designed for efficient use of the system and safety of the operator.

Briefly described according to one embodiment of the present invention, a practical intelligent assist device is provided that eliminates the complex use of force sensing weigh cells and vector interpreting software. By simplifying the input to a series of traditional voltage inputs, i.e. 1-4 volt control signals, the use of standard available control componentry becomes available. Utilizing a series of such simplified inputs, including a load angle feedback, the processing of the vector math can be accomplished within a programmable logic controller (PLC). Outputs can then be simply generated to control a series of 0-60 Hz digital signals to drive AC variable frequency direct drive gear motors. In this fashion, maintenance, repair, installation, programming, etc. can be done with the resources of the plant level technical resources, with little or no reliance on proprietary hardware and software, or specialized technical consultants.

Advantage of the present invention are the ability to connect and integrate a number of IAD components selected from those generally available devices that manufacturing facilities are already familiar with in the operation and maintenance, i.e., no complex, proprietary systems, and a computer interface design that allows an technician or system integrator to easily program, operate and monitor the status.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
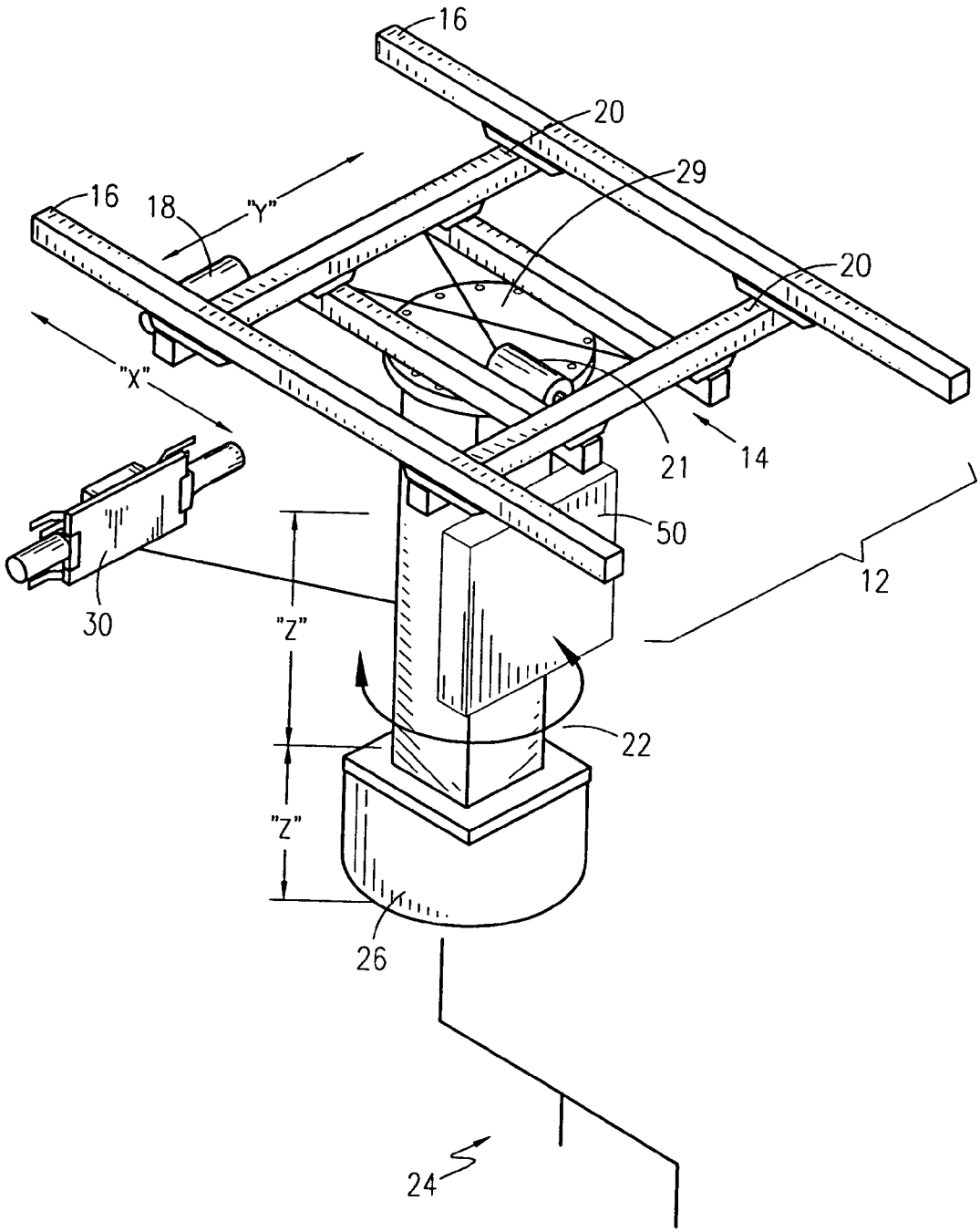
FIG. 1 is a perspective view of a Practical Intelligent Assist Device, or PIAD, according to an exemplary embodiment of the present invention.

Because IADs are intended for close interaction with human operators, unambiguous communication of IAD mode of operation to the human operator is particularly important. The man-machine interface should be clearly and ergonomically designed for efficient use of the system and safety of the operator. Ease and intuitiveness of operation is necessary for achieving high levels of productivity. Because of the close interaction of man and machines, safety of the human operator is most important so that attention should be paid to the design of the operator's controls such that inadvertent or mistaken changes of mode are minimized. As such, a number of fail-safe systems are known in the art and it is anticipated that they can be easily incorporated within a PIAD.

For purposes of an enabling disclosure, an exemplary mode for carrying out the invention is presented in terms of a preferred embodiment, herein depicted within the Figures.

DETAILED DESCRIPTION OF THE FIGURES

Referring now to FIGS. 1-5, a practical intelligent assist device generally noted as 10 is shown having a support 12, shown herein as an overhead rail support, and a power assisted manual manipulator 14. The support 12 is anticipated as being movable and variably affixable within the manufacturing environment. For purposes of disclosing the enablement of the present invention, the support 12 is shown as a pair of parallely spaced overhead rails 16 defining a generally horizontal first axis "X". The power assisted manual manipulator 14 is shown as a carriage supported on the overhead rail and movable along the X-axis by a bridge drive assembly 18 housing a first AC drive motor. The operation of the bridge drive assembly and first motor 18 will be described in greater detail below, but it is anticipated that a number of such motors can be used together to accomplish movement of the carriage 14 along the X-axis. The carriage 14 itself is shown as being formed of a pair of parallely spaced support rails 20 defining a generally horizontal second axis "Y" perpendicular to the first axis "X". A lift mechanism 22 for moving an end effector 24, wherein said lift mechanism 22 is supported by carriage support rails 20 and having a main arm extending from said carriage 14 in a third axis "Z" and being rotatable in the plane of the X-Y axes. The carriage 14 is movable along the Y-axis by fixture drive assembly 21 having a second AC drive motor. A vertical lift mechanism 26, shown herein as a pneumatic lift, provides vertical control of the end effector 24. It is anticipated that a number of interchangeable end effectors can be utilized, with each being binary coded with a proximity sensor and proximity flag combination that would allow the device 10 to automatically adapt the programming for the controls to conform to the use limits and functionality of the specific end effector. A linkage 29 pivotally attaches the lift mechanism 22 to the carriage 14, and provides to the system an input that allows the calculation of the directional angle of the end effector 24 relative to the support axes X and Y as will be described in greater detail below.

Figure 2:
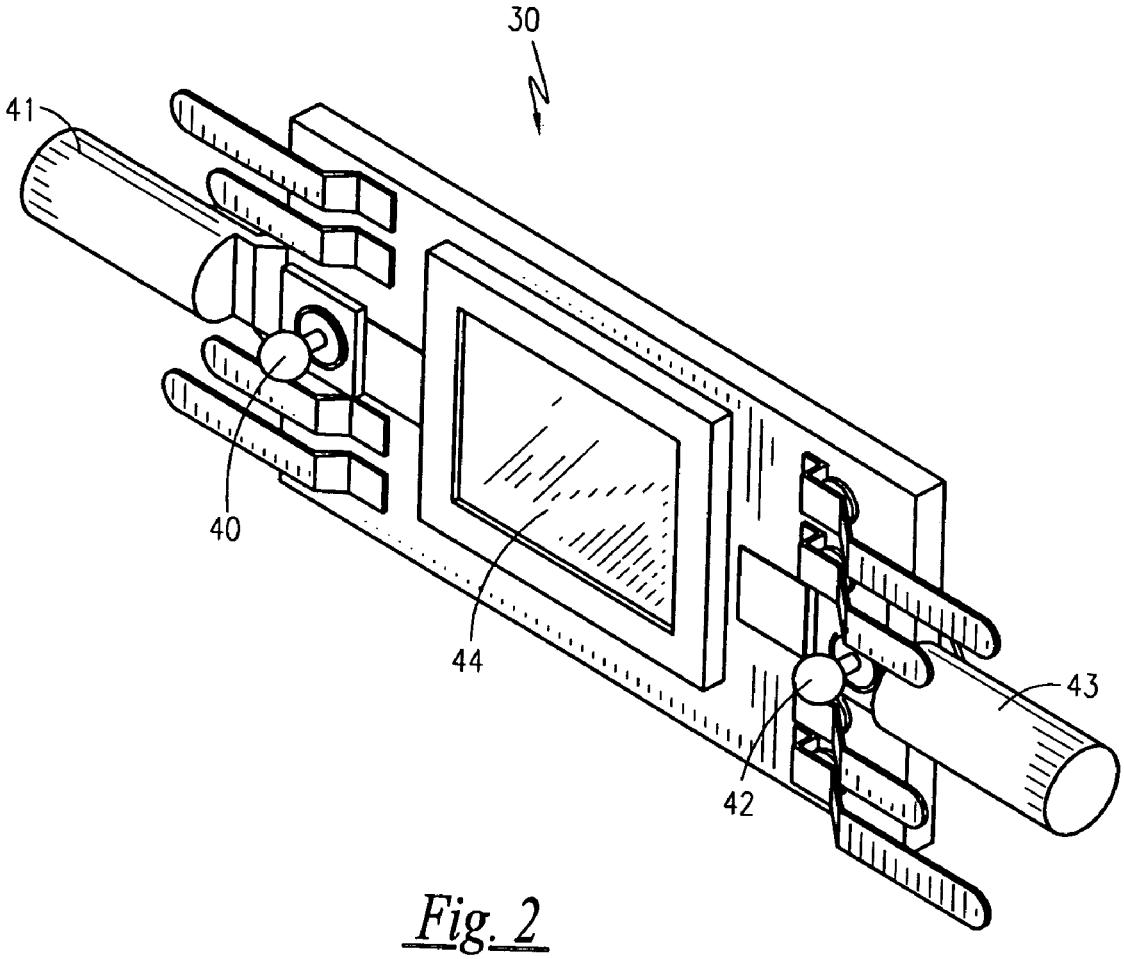
FIG. 2 is a perspective view of an operator control mechanism 30 for use therewith.

An operator control mechanism 30 for receiving the operator inputs and provide intent commands to the control mechanism is affixed to the lift mechanism 22 in a position fixed relative to the end effector 24, and in a position that allows the operator to easily see the end effector and to provide guidance and control thereto. Instead of a plurality of force sensors disposed between the operator control mechanism and the lift mechanism as would be provided in the prior art, FIG. 2 shows in greater detail the more practical operator control mechanisms of the present invention. Operator inputs are anticipated as being provided by a left joystick 40, a right joystick 42, and a display touchscreen 44. In general, the touchscreen 44 is anticipated as being supported in the center of the control mechanism 30, with a left hand grip 41 and a right hand grip 43 extending laterally outward therefrom. This provides an intuitive ergonomic for gripping, guiding, and controlling the end effector 24. The operator must grasp both the left hand grip 41 and right hand grip 43 in order to engage a safety interlock (not shown) anticipated as preventing movement of the system unless actual operator contact at both hand grip positions can be confirmed. Once such a safety condition is met, the left joystick 40 and right joystick 41 can be engaged. Although the control functionality of each joystick can be interchangeable, for purposes of disclosure the left joystick 40 controls the vertical motion of the end effector 24. Placed at a locations on the left hand grip 41 easily manipulated by the operator's left thumb, by toggling the left joystick 40 up or down a variable current signal generated between 1 volt (full down) to 4 volt (full up) or proportionally there between is generated as an operator vertical intent input. Based upon the value of this signal, a programmable logic controller (PLC) 50 or similar control system of a type readily industrially available and known can determine the operators's intent on the desired vertical vector for the end effector, i.e., the direction (up or down) as well as rate of rise or decent (speed) is extrapolated from this operator vertical intent input. For example, a 1 volt signal would represent a rapid lowering of the end effector; a 4 volt signal would represent a rapid raising of the end effector.; a 2.5 volt signal would represent no vertical motion; a 3.25 volt signal would represent a (relatively) slow raising of the end effector; and so on.

Similarly, the right joystick 42 controls the horizontal motion of the end effector 24. Placed at a locations on the right hand grip 43 easily manipulated by the operator's right thumb, by toggling the right joystick 42 left or right, front or back, a pair of variable current signal generated between 1 volt (full left) to 4 volt (full right) or proportionally there between is generated as an operator horizontal intent input. Based upon the value of this signal, a programmable logic controller (PLC) 50 can determine the operators's intent on the desired horizontal vector for the end effector, i.e., the direction (left, right, forward, backward) as well as rate of movement (speed) in the desired direction is extrapolated from this operator horizontal intent input. For example, a 1 volt signal would represent movement of the entire carriage 14 rapidly to the left; a 4 volt signal would represent a rapid movement to the right; a 2.5 volt signal would represent no horizontal movement; a 3.25 volt signal would represent a (relatively) slow movement to the right; and so on.

While lateral intent can be inferred from such an operator horizontal intent input, the actually direction that the operator desires the carriage 14 to travel will be relative to the current position of the carriage 14 or end effector 24 within the X-Y plane. In order to determine this relative motion, and thus the intent of the operator, a column angle feedback from the linkage 29 provides a column pivot position. This is anticipated as being provide by a resolver based rotary encoder, such as provided by an AMCI Duracoder™ or functional equal. Such an encoder provides a control signal, herein a 0-10VDC control in put that is a proportional function to the rotary position of the linkage 29. The column angle feedback, along with the joystick feedback, determines the final trajectory of movement. The joystick 42 feeds back two analog 1-4 volt signals to the processor 50. One signal is the X-plane control signal, the other is the Y-plane control signal. These X and Y coordinates are translated into a joystick vector that describes the angle and magnitude of motion being commanded by the operator. The rotating column 29 has a single feedback device into the processor that is translated into a column feedback angle position. This column angle position then offsets the joystick vector angle to form a final trajectory relative to the bridge position or the X-Y plane of the system. This vector is then decoded into two vectors: one in the X plane; and, one in the Y plane. The sum of these two vectors equals the final trajectory vector. The X and Y vector magnitude are then outputted to the various AC direct drive gear motors (for the bridge drive assembly 18 and fixture drive assembly 21) to determine final drive speeds.

This results in an intuitive form of motion: if the operator pushes the joystick 42 forward, the PIAD 10 travels forward relative to the position of the column 14. Another advantage that can be extrapolated from this simple programmability and intuitive functionality is the ability for remote operator synchronization, in which the device 10 is tracked stationary relative to a moving assembly line. By tracking to follow the line speed, the joystick functionality can be programmed to have consistent relative functionality, independent of line speed.

Figure 3:
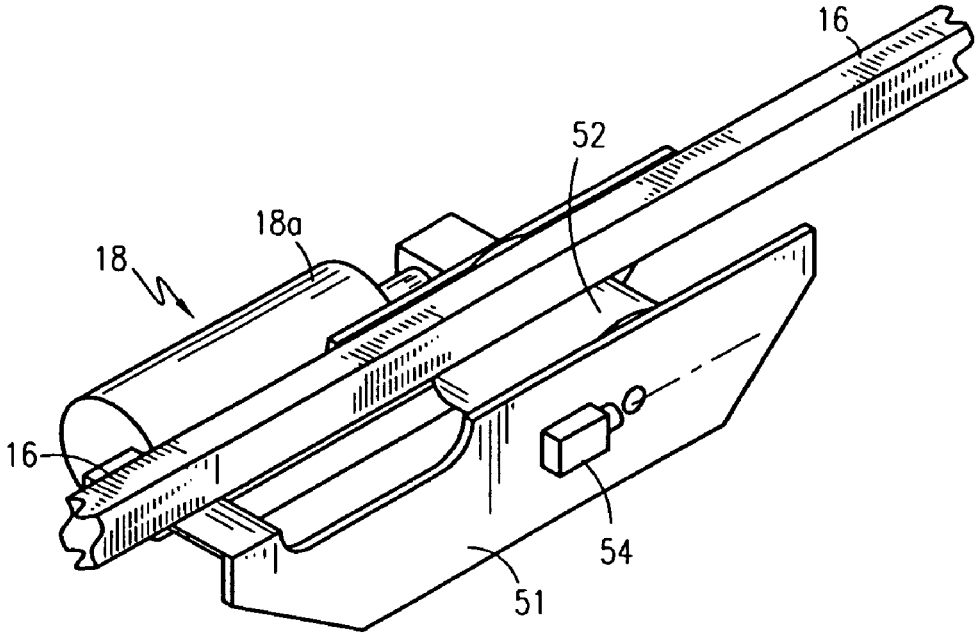
FIG. 3 is a detailed perspective view of a bridge drive assembly 18 for use therewith.

Referring now to FIG. 3, the bridge drive assembly 18 is shown in greater detail, in which and first motor 18*a* is supported to a first trolley housing 51. The trolley housing 51 is fabricated to be adaptable to a number of existing overhead rail systems that are currently in use. The motor 18*a* drives a bridge drive roller 52 that rides upon the overhead rails 16, and the housing 51 connects to the carriage 14 such that as the first motor 18*a* drives the drive roller 52, the carriage 14 will move about the rails 16 along a generally horizontal first axis "X". The motor 18*a* is anticipated as being an AC direct drive gear motor, such that the speed of the motor will be directly proportional to a 4-20 mA control signal output from the controller 50. Relative "position" of the carriage 14 about the X plane is determined by at least one analog laser sensor 54, mounted rigidly to the trolley housing 51 and aimed at a fixed target (not shown) positioned at a reference location along the rail 16.

Figure 4:
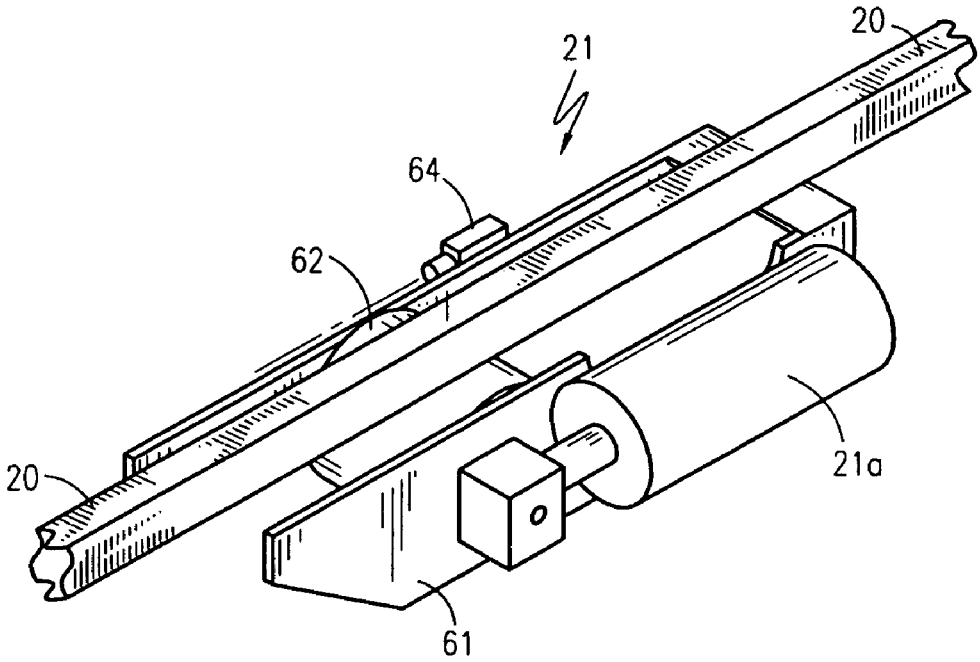
FIG. 4 is a detailed perspective view of a fixture drive assembly 21 for use therewith.
Figure 5:
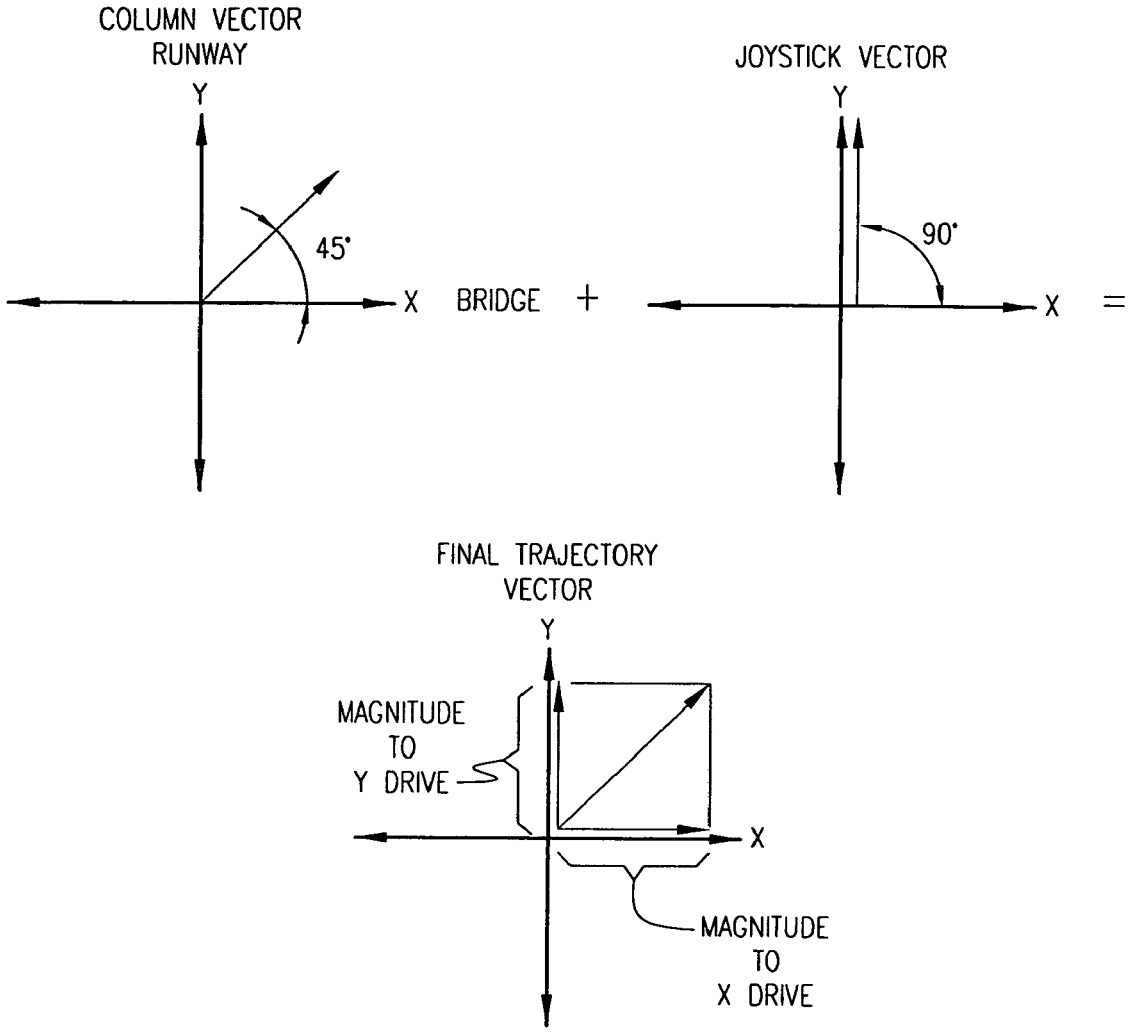
FIG. 5 is a vector diagram describing the operation of the column pivot position for use therewith.

Referring now to FIG. 4, the fixture drive assembly 21 is shown in greater detail, in which a second motor 21*a* is supported to a second trolley housing 61. The trolley housing 61 is fabricated to be adaptable to a number of existing overhead rail systems that are currently in use. The gear motor 21*a* drives a fixture drive roller 62 that rides under the support rails 20 of the carriage 14, and has a pneumatic cylinder to apply an upward engagement force. The housing 61 connects to the lift mechanism 22 is such that as the second motor 21*a* drives the drive roller 62, the lift mechanism 22 will move about the rails 20 along a generally horizontal second axis "Y". The motor 21*a* is anticipated as being an AC direct drive gear motor, such that the speed of the motor will be directly proportional to a 0-10 VDC control signal output from the controller 50. Relative "position" of the lift mechanism 22 along the carriage 14 about the Y plane is determined by at least one analog laser sensor 64, mounted rigidly to the trolley housing 61 and aimed at a fixed target (not shown) positioned at a reference location along the rail 20. It is anticipated that the use of such position sensing can allow the operator to program "null zones" or "travel limits" along the overall work area, or to program pre-determined automatic travel paths. However, it is also anticipated that such analog linear target detection can be used to reduce the travel speed of the bridge drive assembly 18 as it approaches the travel limit of the overhead rails 16, or the speed of the lift mechanism 22 along as is approaches the travel limits of the carriages rails 20, or both.

Finally, various other control of the lift mechanism 22 or end effector 24 can be accomplished through the display touchscreen 44, as well as other informational reporting or display. Functions such as clamping or unclamping of the end effector, release or locking of the entire carriage or lift mechanism, or other various alarms can be controlled from or displayed on this user input means. It is anticipated that in a manufacturing environment that will find the most use from an intelligent assist device will require various functionality, programmability, and adaptability in a manner that is direct and easy to operate, while at the same time being capable of being programmed, tuned, and maintained without the need of specialty hardware or technical resources that are generally unavailable in most manufacturing settings. The use of such a joystick-handgrip-touchscreen combination is intended to meet this goal without resorting to a complex, difficult to tune force-based control device that range from single axis payload balancing to multiple degree of freedom articulated manipulators.

OPERATION OF THE PREFERRED EMBODIMENT

In operation, the present invention disclosed herein provides for a more natural and intuitive control of the motion of a payload. The system and method are implemented on an overhead rail system of known type. In such use, the operator would merely guide and direct the end effector by providing directional input to the joystick 40, 42. Because the left-right control signal is calculated relative to the actual angular position of the lift column 22, such a control signal will always be interpreted relative to the position that the operator is facing, i.e. toward the load or end effector.

It should be understood, however, that the present embodiments are not limited to the exemplary embodiments disclosed herein, but that they may also be implemented in systems that utilize other kinds of material handling systems including gantry cranes, jib cranes, monorails, articulated systems, and so forth. Therefore, details regarding the overhead rail system including the types of material handling hardware are provided as an example, and are not necessary to the invention unless otherwise specified as such.

Figure 6:
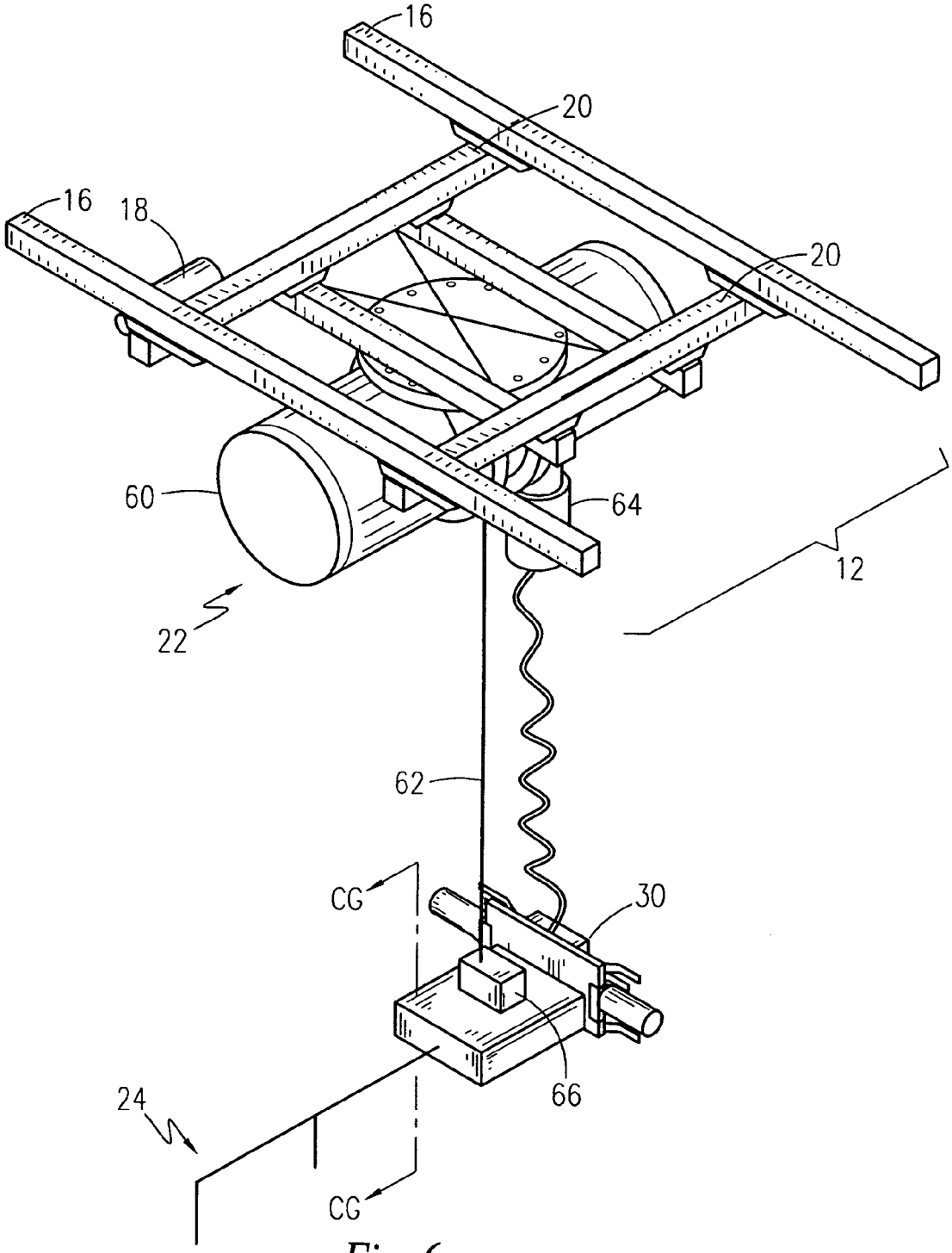
FIG. 6 is a perspective view of a cable type Practical Intelligent Assist Device according to an alternate embodiment of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. Once such example is shown in FIG. 6, in which a cable-type practical intelligent assist device generally noted utilizing a similar support 12 as with the previously described embodiment in which an overhead rail support is movable and variably affixable within the manufacturing environment.

In this embodiment, a pneumatic hoist 60 drives a cable support 68. The end effector 24 is supported at it's center of gravity through axis "CG-CG", with the operator control mechanism 30 for receiving the operator inputs and provide intent commands to the pneumatic hoist 60 as well as the various "X" axis and "Y" axis controls as previously described. It is envisioned that the "Z" axis lift control of the cable 68 via the pneumatic hoist 60 can be accomplished by a conventional analog regular for converting conventional 0-10 VDC control signals in to an adjustable and controllable pneumatic pressure. Based upon the value of this signal, the analog regulator 64 can determine the operators's intended vector based upon the desired operator intent input. Additional features, such an an electronic compass 66, can provide additional directional feedback for calculation in the control signal.

The above embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A power assisted manual manipulator comprising:

a support capable of being moveable and variably affixable within a manufacturing environment;

a carriage supported on said support and movable along a first horizontal direction;

a bridge drive assembly for imparting movement onto said carriage along said horizontal direction;

a fixture drive assembly for imparting motion within said carriage along a second horizontal direction perpendicular to said first horizontal direction;

a lift mechanism moving an end effector, wherein said lift mechanism is supported by rails of said carriage and being rotatable below the plane formed by said first horizontal direction and said second horizontal direction;

an operator control mechanism provided as a means to receive an operator's inputs, said operator control mechanism thereby directly encoding signals to command a control mechanism, said operator control mechanism being in a position fixed relative to said end effector, and in a position that allows an operator to easily see said end effector and to provide guidance and control thereto, said operator control mechanism comprises:

a fixed left hand grip;

a left joystick proximate to said left hand grip, said left joystick is manipulated by the operator's left thumb when said left hand grip is wrapped in the operator's left palm;

a fixed right hand grip;

a right joystick proximate to said right hand grip, said right joystick is manipulated by the operator's right thumb when said right hand grip is wrapped in the operator's right palm;

wherein said right grip and said left grip provides an ergonomic grip for gripping, guiding and controlling said operator control mechanism.

2. The power assist manual manipulator of claim 1, wherein said left joystick controls a vertical motion for said end effector.

3. The power assist manual manipulator of claim 1, wherein said right joystick controls-a horizontal motion of said end effector, said horizontal motion moves in a first direction and a second direction.

4. The power assist manual manipulator of claim 1, wherein said left joystick generates a variable current signal generated between 1 volt (full down) to 4 volts (full up) and proportionally there between, thereby generating a current operator vertical intent input.

5. The power assist manual manipulator of claim 4, further comprising a programmable logic controller that can determine the operators's intent on the desired vertical vector for the end effector, said programmable logic controller can determine the operators intended direction and rate of rise or decent based on extrapolations from this operator's vertical intent input.

6. The power assist manual manipulator of claim 5, wherein said bridge drive assembly comprises:

a first trolley housing adaptable to an overhead rail system;

a first motor driving a driver roller and supported to said first trolley housing and connected to said carriage such that as said first motor drives said drive roller, said carriage will move along a generally horizontal first axis "X";

said first motor being a direct drive motor, such that the speed of the motor will be directly proportional to a 4-20 mA control signal output.

7. The power assist manual manipulator of claim 6, wherein the relative position of said carriage about said X plane is determined by at least one analog laser sensor mounted rigidly to said first trolley housing and aimed at a fixed target positioned at a reference location.

8. The power assist manual manipulator of claim 1, wherein said right joystick generates a variable current signal generated between 1 volt (full left) to 4 volts (full right) and proportionally there between, thereby generating a current operator horizontal intent input.

9. The power assist manual manipulator of claim 8, further comprising a programmable logic controller that can determine the operators's intent on the desired horizontal vector for the end effector, said programmable logic controller can determine the operators intended horizontal direction and its rate based on extrapolations from the operator's horizontal intent input.

10. The power assist manual manipulator of claim 9 or 6, wherein said fixture drive assembly comprises:

a second trolley housing adaptable to an overhead rail system;

a second motor driving a driver roller and supported to said second trolley housing and connected to said carriage such that as said second motor drives said drive roller, said carriage will move along a generally horizontal second axis "Y";

said second motor being a direct drive motor, such that the speed of the motor will be directly proportional to a control signal output.

11. The power assist manual manipulator of claim 10, wherein the relative position of said carriage about said Y plane is determined by at least one analog laser sensor mounted rigidly to said second trolley housing and aimed at a fixed target positioned at a reference location.

12. The power assist manual manipulator of claim 1, further comprising a column angle feedback to provide a control signal that is proportional to the rotary position of said lift mechanism.

13. The power assist manual manipulator of claim 1, further comprising a plurality of removable, interchangeable end effectors, wherein upon changing said end effector said changes functionality specific to that of the appropriate attached end effector.

14. The power assist manual manipulator of claim 1, wherein said the functionality of said left joystick and said right joystick are programmable.

15. The power assisted manual manipulator of claim 1, wherein a pneumatic hoist drives a cable support.

* * * * *